US006240666B1

(12) United States Patent
Apel et al.

(10) Patent No.: US 6,240,666 B1
(45) Date of Patent: Jun. 5, 2001

(54) INFLATABLE INFORMATION CARRIER

(76) Inventors: Raimund Apel, Goethestrasse 15, D-34119 Kassel (DE); Michael Lazar, Herwigsmühlenweg 3C, D-34123 Kassel (DE)

( * ) Notice: Subject to any disclaimer, the term of this patent is extended or adjusted under 35 U.S.C. 154(b) by 0 days.

(21) Appl. No.: 09/283,415

(22) Filed: Apr. 1, 1999

(30) Foreign Application Priority Data

Apr. 3, 1998 (DE) ..... 298 06 145 U

(51) Int. Cl.[7] ..... G09F 15/00

(52) U.S. Cl. ..... 40/610; 40/602; 40/606; 40/624

(58) Field of Search ..... 40/602, 606, 610, 40/624, 212, 214; 446/220; 248/123.1, 331

(56) References Cited

U.S. PATENT DOCUMENTS 3,280,521 * 10/1966 Keathly ..... 40/624 X
3,729,847 5/1973 Chandos .
4,019,271 * 4/1977 Latimer ..... 40/602 X
4,369,591 * 1/1983 Vicino ..... 40/610
4,776,121 * 10/1988 Vicino ..... 40/610
5,542,203 * 8/1996 Luoma et al. ..... 40/610
5,791,077 * 8/1998 Felber ..... 40/610

FOREIGN PATENT DOCUMENTS 296 17 592 U 10/1996 (DE) .
2598541 5/1986 (FR) .

* cited by examiner

*Primary Examiner*—Terry Lee Melius
*Assistant Examiner*—James M Hewitt
(74) *Attorney, Agent, or Firm*—Thomas R. Vigil

(57) ABSTRACT

An information carrier for receiving at least one information data. The information carrier includes an inflatable hollow body made of a flexible, foldable material and a blower for blowing an air flow into the inner part of the hollow body. The blower is arranged in or on the hollow body in such a way that the air flow produced by the blower builds up an overpressure within the hollow body whereby the hollow body adopts a stationary and stable rectangular frame shape over which the information banner may be fastened, more particularly removably fastened, while at least partly covering the open space within the frame.

18 Claims, 5 Drawing Sheets

INFLATABLE INFORMATION CARRIER

BACKGROUND OF THE INVENTION

1. Field of the Invention

The present invention relates to an information carrier receiving at least one information banner comprising an inflatable hollow body made of a flexible, foldable material and of a blower blowing an airflow into the inner part of the hollow body. The blower is arranged in or on the hollow body in such a way that the airflow produced by the blower builds up an overpressure within the hollow body and, as a result, the hollow body adopts a stationary and stable outer shape.

2. Description of the Prior Art

The DE 296 17 592 U1 discloses an inflatable, cylindrical information carrier being vertically installed like an advertisement pillar. In this case, an overpressure is built up within the hollow body by means of a blower arranged in the inner part of the hollow body so that the hollow body comes to stand upright, just as an advertisement pillar. Such an inflatable information carrier has a diameter of up to 2 m and a height of up to 12 m. To prevent these inflatable advertisement pillars from tipping over by the wind power, they are secured by anchoring cables anchored in the ground. This inflatable information carrier can easily be folded and transported, so that they can be installed in a fast and cheap way at the desired location.

Inflatable information carriers are either directly printed with the advertising or information to be shown or they carry information banners on the outer side of the hollow body, depending to the size of the advertisement to be shown. This entails that the advertising space available is limited by the circumference and the height of the said inflatable advertisement pillar.

The FR 2,598,541 discloses an inflatable, rectangular balloon carrying a screen printed with information inside. The balloon is to be filled with a gas, for example helium, so that the balloon lifts up to a height of 50 m to 100 m and is fixed with ropes or the like to make sure that the balloon does not disappear.

The U.S. Pat. No. 3,729,847 discloses an inflatable frame like display banner having indicia located in the center thereof that may be collapsed for storage and/or shipment. Furthermore, this display banner comprises a number of bores or openings, through which securing elements like a band, a rope or the like can be adapted to secure the inflatable banner to a standard.

SUMMARY OF THE INVENTION

The object of the present invention is therefore to provide a transportable, inflatable information carrier offering a bigger advertising space while keeping its transportability without occasioning too high manufacturing and installation costs.

The technical solution of this object is to develop the information carrier so that the hollow body forms a closed, more particularly rectangular frame, onto which the information banner may be fastened, preferably removably fastened, while at least partly covering the free space constituted by the frame.

An information carrier designed according to the teachings of the present invention has the advantage that a comparatively big surface is tenterable on the frame, whereas this surface may be provided with information or with advertisements, respectively. Simultaneously, the principle of an inflatable and again foldable hollow body is kept so that the information carrier may easily be transported. Thus, the manufacturing as well as the installation and removing costs remain low.

The frame may then be provided, on its front side as well as on its rear side, with one or several information banners bearing the respective printed information. In another embodiment, the information banner remains permanently secured on the frame.

In a preferred embodiment the hollow body has adopted a rectangular shape and is up to 20 m high and up to 30 m wide. It has been found that an information banner having a size of 10 m by 16 m may be realized at particularly low costs. In another preferred embodiment, a lip is provided on the front and/or on the rear side of the hollow body onto which the information banner and/or anchoring cables can be secured.

In an advantageous development, the lip is made by an outwardly extending fold at the inflatable hollow body and is provided with a number of eyes and/or Velcro fasteners by means of which the information banner is securable onto the hollow body.

Such a lip has the advantage that the information banner and/or the anchoring cables may easily be mounted and that the necessary mounting devices, more particularly the eyes and/or the Velcro fasteners, may be arranged on the outside and not on the hollow body itself. By arranging the fastening devices, more particularly the eyes and/or the Velcro fasteners, on the outside, the hollow body itself is spared from being damaged by torn out eyes or the like, so that its durability is thus considerably increased. Moreover, it is very easy to provide a fold on the hollow body by means of an additional seam, the eyes and/or the Velcro fasteners being then integrated into said fold.

In a quite similar way, a holding lip may be provided on the inner side of the hollow body, onto which a view protection described hereinafter is mountable.

Another advantage of the lip or the holding lip is that it is easily accessible and still of a very solid design, so that the information banner and/or the view protector may easily be mounted or dismounted.

In another, preferred embodiment a view protection preferably composed of several lamellar and/or net-like strips of material is arranged in viewing direction, behind the information banner. The information banners are preferably made of a net-like linen cloth, and they are not only permeable to wind, but also to light, so that the information borne by the information banner can hardly be seen, especially when the sun is shining. The view protection arranged behind the information banner is preferably black and shields light sources arising behind the information banner, bringing thus the advertisement on the information banner to bear.

Since such a big information carrier may be tipped over by a strong wind, in a preferred embodiment the information banner and/or the view protection should be designed as being permeable to wind. Hence, the resistance of the information carrier against air or wind is reduced and its stability increased. In a particularly preferred embodiment, additional anchoring cables may be arranged on the hollow body of the information carrier for additionally securing the information carrier. The anchoring cables are moored in the ground for example by means of ground anchors, nails or the like.

The information carrier according to the invention should be installed in a location frequented by the corresponding public. Such locations are often large spaces in front of shopping malls, event halls or the like. It is normally difficult to use ground anchors, nails or the like in such places, since they are mostly provided with a closed asphalt pavement or any other closed surface which cannot be damaged. In order to install the information carrier according to the invention in such a place and to be able to secure it against gusts by means of anchoring cables, it is suggested to fasten the anchoring cables onto a ballast element which can be movably placed onto the ground and which is made of a liquid resistant, flexible and foldable material. This ballast element may then be filled with a liquid, more particularly with water, and thus reliably maintains the information carrier in the desired position.

In a preferred development, the ballast element has a pyramidal shape. The advantage thereof is that the center of gravity of the ballast element lies very low and that simultaneously a comparatively big base is provided, so that the ballast element is reliably prevented from turning over or wandering about. The pyramidal-shaped ballast element achieves an extremely high stability with a comparatively small amount of water, so that the ballast element can be filled or emptied rapidly without incurring high costs.

In order to further stabilize or increase the stability of the ballast element, loops have been provided on the edges into which tubes or rods are engaged, whereas the tubes or rods are connected to each other on their free ends by means of connecting clamps. These tubes or rods thus increase the unspillability of the ballast element on one hand, on the other hand they are protecting the flexible material of the ballast element from damages, for example by skateboarders, cyclists or the like.

In still another preferred embodiment, a box having a semi-cylindrical recess for a form-fitting reception of the inflated hollow body is arranged on the underside of the hollow body, the deepest part of the recess reaching at least nearly to the bottom of the box. Among other functions, this box is needed to fix and fasten the hollow body at first. To that purpose, a semi-cylindrical recess is provided in the middle part of the box into which the lower leg of the hollow body can be form-fittingly inserted. In a preferred development, the blower and/or a generator are located in the box, so that the recess can be provided with an air admission hole through which the compressed air of the blower gets into the hollow body.

In this preferred embodiment, the air admission hole area of the hollow body is permanently located in the recess of the box. For transportation, it is folded so as to come to lie on the box. Thus, the mounting and dismounting of the information carrier is quick, since the blower and the air admission do not have to be mounted and connected newly each time. Designing the recess so that it at least nearly reaches the bottom of the box has the advantage that the lower edge of the hollow body only has to over-come a small difference in height when going over into the recess, so that a potential damage of the hollow body at this place can be avoided and that the hollow body can rest on the ground with the whole of its width.

For additionally fastening the hollow body onto the box, rod-shaped elements are provided on the edge of the recess, the elements engaging into corresponding loops arranged on the hollow body. This already guarantees a fastening of the information carrier, which is normally sufficient. If necessary, anchoring cables may additionally be arranged to particularly secure the information carrier against wind or gusts.

In a preferred development, the box is additionally provided with a storing compartment, particularly used for storing the folded ballast element. It is thus possible to store the information carrier together with all the required units and component parts in one unique and compact box, so that at the mounting place all component parts are always at hand and that transportation is easy and handy.

In order to even further simplify transportation, the box is provided with wheels, which are adjustable in height and which may be removed by screwing for transport. Thus, the box only has to be lifted on one side and simply wheeled to any location.

Further advantages of the device according to the invention will result from the drawing enclosed and from the embodiments described in the following. In a similar way, the features mentioned above and those still to be described may be used according to the invention each on its own as well as in any combination. The embodiments mentioned are not to be understood as a terminal enumeration, they rather serve as examples.

DESCRIPTION OF THE PREFERRED EMBODIMENTS

Figure 1:
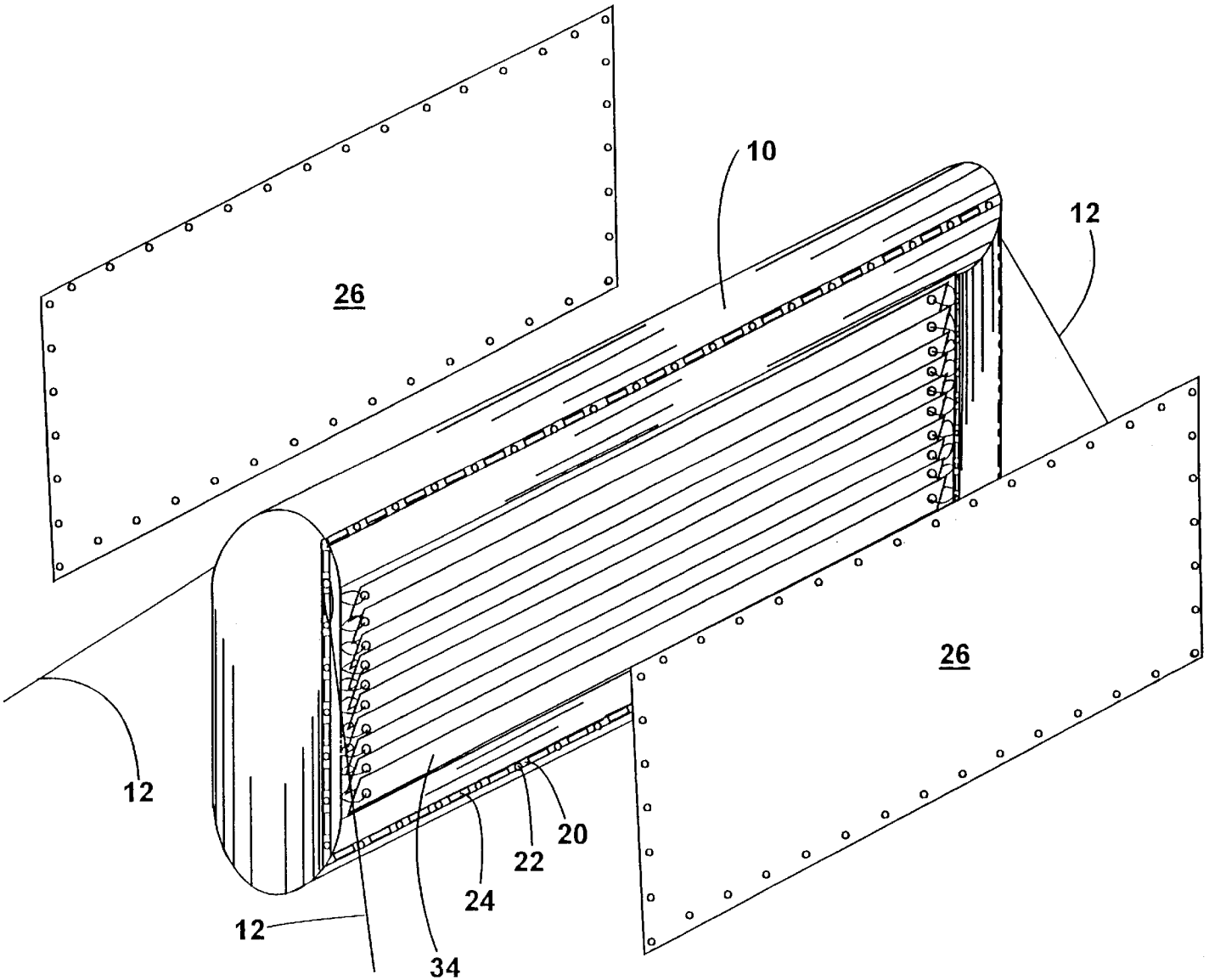
FIG. 1 shows an exploded perspective view of an information carrier according to the present invention.
Figure 2:
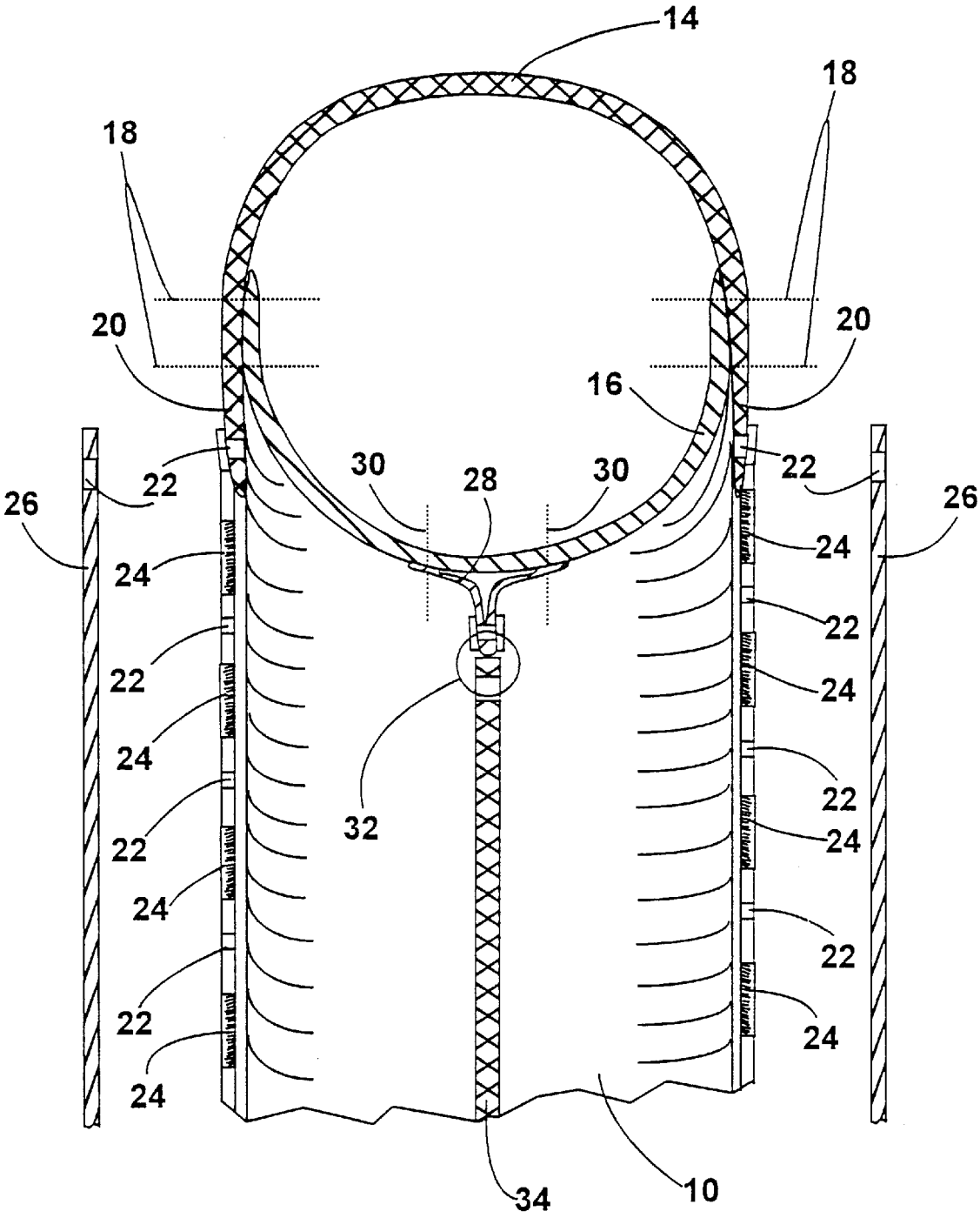
FIG. 2 shows a top sectional view of a part of the information carrier according to FIG. 1.

The information carrier shown in FIGS. 1 and 2 comprises a closed hollow body 10 being accommodated perpendicularly and having a circular cross section. Approximately in the center of the hollow body 10, a blower (not shown) producing a (cold) airflow is connected. The hollow body 10 made of a flexible PVC is inflated by means of this (cold) airflow so that it comes to stand upright. In order to secure the hollow body 10 against tipping over, especially when wind is blowing, several anchoring cables 12 are provided fastened to the hollow body in its upper part.

The hollow body 10 is made of several strips 14, 16 of PVC net-like fabric sewn together, whereas the strip 14 arranged on the outer side of the frame-like hollow body 10 is somewhat bigger than the strip 16 provided on the inner side of the frame-like hollow body 10. As shown in FIG. 2, the two strips 14 and 16 are provided with two double seams 18 so that a roundgoing lip 20 is formed on the front side as well as on the rear side of the hollow body 10. This lip 20 is roundgoing just as the hollow body 10. The lip 20 is provided with a number of equally distant eyes 22. These eyes 22 are spaced from each other at a distance of approximately 25 cm, whereas a Velcro fastener 24 of about 10 cm length is provided between two neighboring eyes 22, so that an eye 22 alternates with a Velcro fastener 24 over the whole length of the lip 20.

In the embodiment disclosed herein, the hollow body 10 has a diameter of 1.5 m and its dimensions are thus that an information banner measuring 10 m by 16 m may be arranged on the eyes 22 and/or on the Velcro fastener 24. This information banner 26 is made of a net-like PVC-fabric which is between 500 $g/m_2$ and 1000 $g/m_2$ strong and which is printed with the information or the commercials to be shown. Due to its net-like structure, this information banner 26 is permeable to wind. It is possible to install one information banner 26 on each side of the information carrier 26 according to the invention so that the information carrier may dispense its information to the front as well as to the rear side.

Each vertical section at the inner side of the hollow body 10 is provided with one holding lip 28 arranged by means of two single seams 30. The holding lips 28 too have several eyes 22 spaced from each other by a distance of 25 cm. Several textile lamellas 34 are hung into these eyes 22 by means of an eye ring 32 and fill up the whole free space tentered by the hollow body 10. These lamellas 34 are preferably made of fleece and are of dark color, more particularly black in order to function as a view protection for the information banner 26. Each lamella 34 has a height of preferably 50 cm. These textile lamellas 34 are flexible so that if wind is attacking the information carrier, it may pass through two adjacent lamellas 34, so that the resistance against wind can be kept low.

Figure 3:
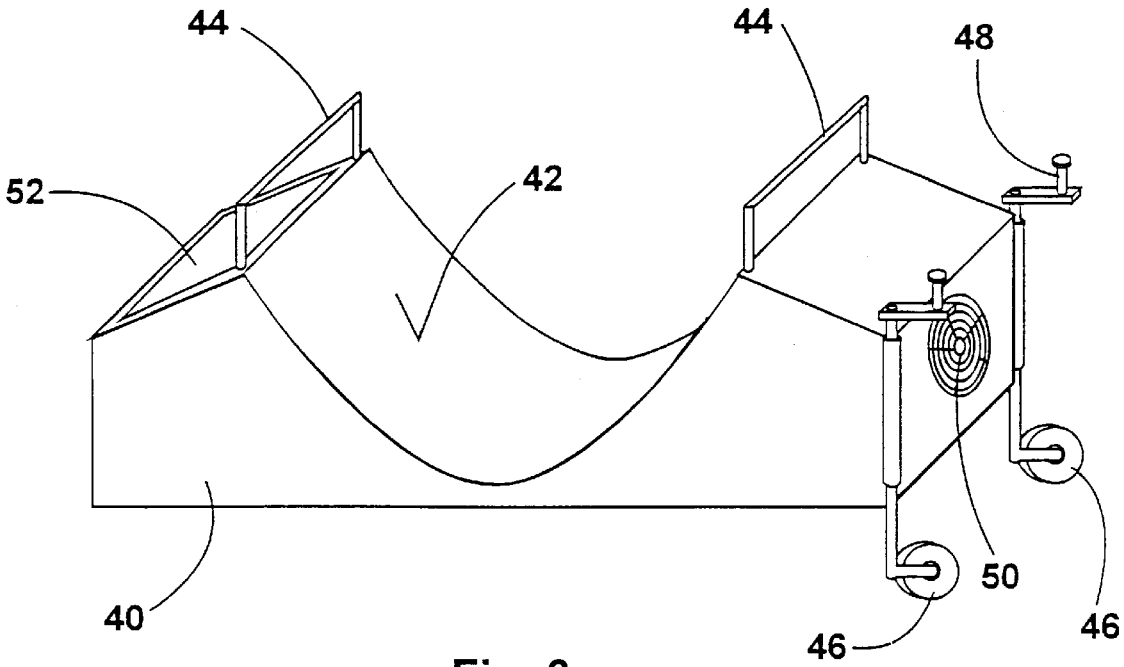
FIG. 3 shows a perspective view of a box according to the present invention with lowered wheels.
Figure 4:
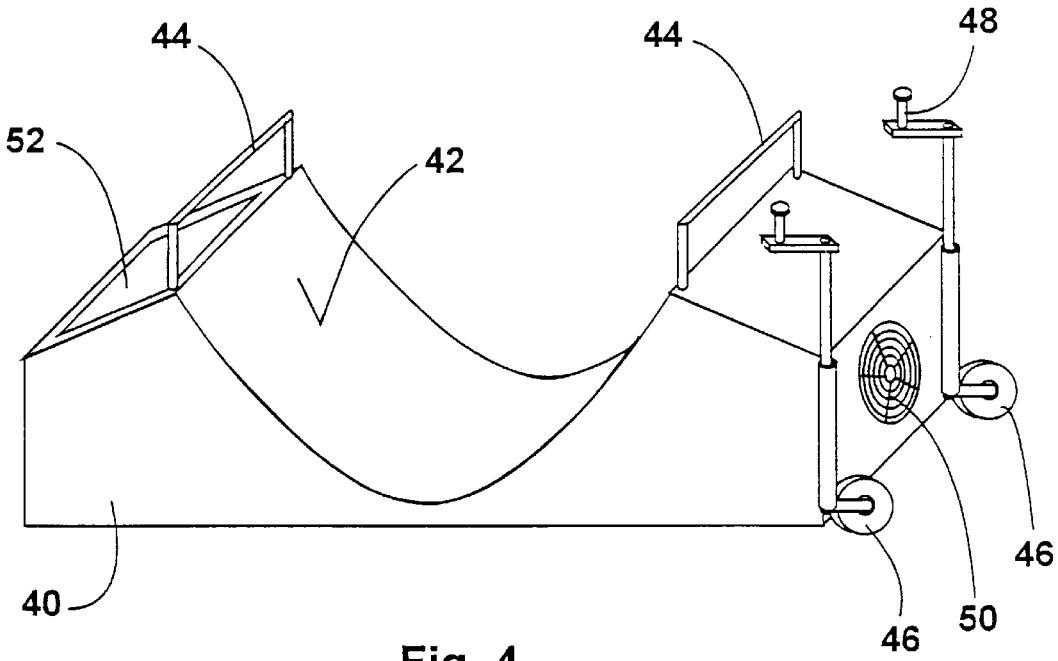
FIG. 4 shows a perspective view of the box according to FIG. 3 with raised wheels.

FIGS. 3 and 4 show a box 40 having in its center a semi-cylindrical recess 42 which receives the lower leg of the inflated hollow body 10. This box is designed so that all the component parts of the information carrier may be stowed in or on it and that it functions as a holding device for the inflated hollow body 10. Once inflated, the lowest leg of the hollow body 10 is inserted into the recess 42 and the rod-shaped elements 44 are inserted into loops (not shown) arranged on the front and rear side of the hollow body 10 in order to maintain the hollow body 10 on the box 40.

On the outside of the box 40, two wheels 46 being adjustable in height are accommodated on one side and may be screwed up and down by means of a crank handle 48 and of a spindle engaged in the crank handle 48. The box 40 has a perfectly even underside and may rest with its whole surface on the underground, for example on grass or asphalt, once the wheels 46 are screwed up.

The right half of the box 40 contains a generator and a blower which is sucking the air required via the air admission hole 50. The hollow body 10 is inserted into the recess 42 and is fixed by means of the rod-like elements 44. Simultaneously, the blower (not shown) is connected to the hollow body 10. Once inflated, the hollow body 10 is held by the box 40. For transportation, the hollow body, which is made of flexible material, is folded and put onto the box 40. On the left side of the box 40 a storing compartment 52 is provided which may stow for example the ballast elements 60 described hereinafter.

In order to transport the whole information carrier from its location to a vehicle, the crank handles 48 are actioned so that the wheels 46 are drawn out and are lifting the box 40 from the ground. The box 40 may now be gripped at on the side opposite to the wheels 46 and may comfortably be drawn or pulled to the vehicle for transportation.

Figure 5:
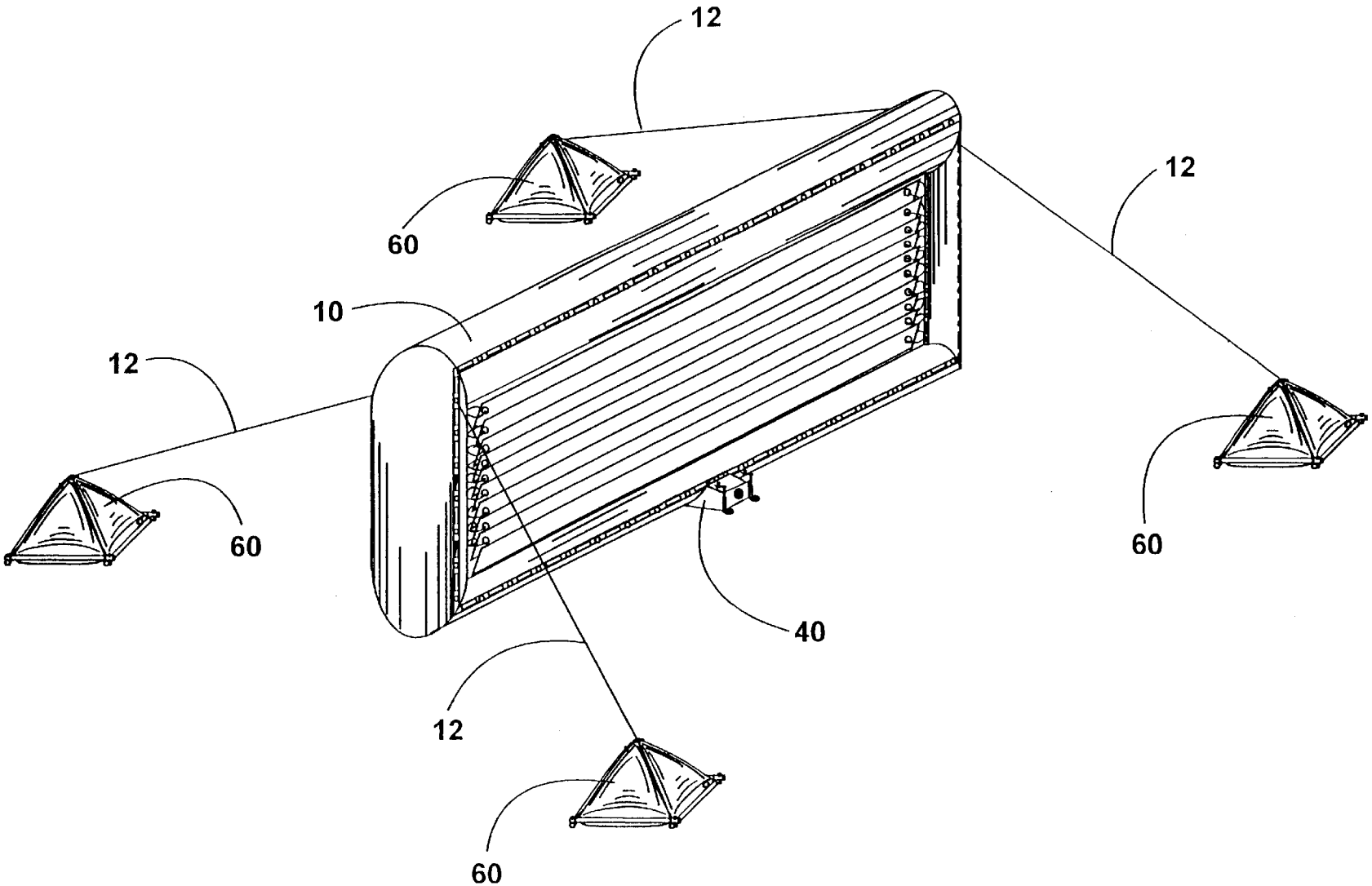
FIG. 5 shows a perspective view of a fully mounted information carrier according to the present invention.
Figure 6:
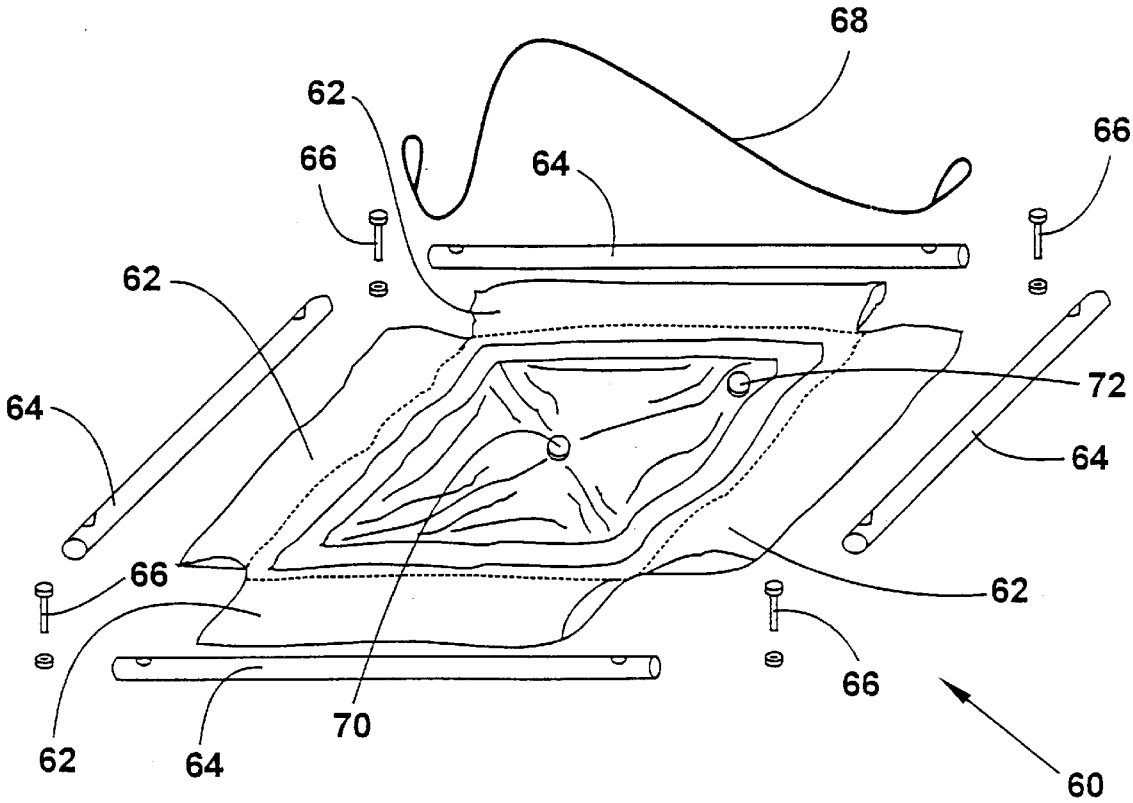
FIG. 6 shows an exploded view of a ballast element according to the invention.
Figure 7:
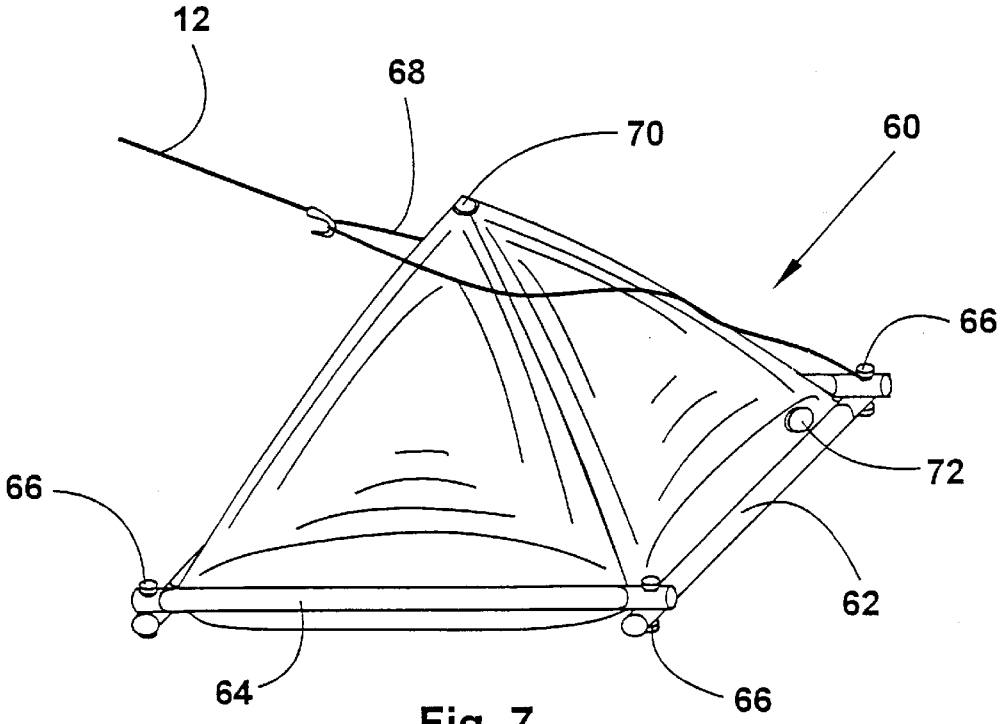
FIG. 7 shows the ballast element according to FIG. 6 filled with liquid.

FIG. 5 shows an information carrier according to the invention provided with four ballast elements 60 fastened to it by means of anchoring cables 12. The ballast elements 60 are shown in more detail in FIGS. 6 and 7. The ballast elements 60 are also made of a flexible, foldable material and have the outer contour of a quadrilateral pyramid. Loops 62 are accommodated on the edges of its base through which tubes 64 made of aluminum are pushed, whereas the tubes 64 are connected to each other by means of connecting clamps 66. The connecting clamps are mounted on two corners by means of a mounting rope 68 into which a trigger is snap located on the anchoring cable may be hung.

Once the ballast elements 60 are mounted, they are filled with water via a receiving connection piece 70 constituting thus a heavy ballast reliably holding the anchoring cables 12. For removing the ballast element, the water may simply be let out via an outlet connection piece 72 and the ballast elements 60 dismantled and folded again for transportation.

The information carrier according to the invention may be folded in a very short period of time into a comparatively small bundle by taking off the information banner 26 and by switching off the blower since the hollow body is made of a flexible, foldable PVC-material. The thus folded hollow body 10 may then be transported together with the information banners 26 in a trailer hauled by a private car for example. The information banner may also be fixedly mounted on the hollow body depending on the use made of it. This is particularly advantageous when the information carrier according to the invention should always carry the same advertisement. Otherwise, the removable information banners are advantageous, since the information carrier may then always be fitted with the information banner just required.

From the foregoing description, it will be apparent that the inflatable information carrier of the present invention has a number of advantages, some of which have been described above and others of which are inherent in the inflatable information carrier of the present invention. Also, it will be understood that modifications can be made to the inflatable information carrier of the present invention without departing from the teachings of the invention. Accordingly the scope of the invention is only to be limited as necessitated by the accompanying claims.

List of Numerals

10 hollow body
12 anchoring cables
14 strip
16 strip
18 double seam
20 lip
22 eyes
24 Velcro fastener
26 information banner
28 holding lip
30 single seam
32 eye ring
34 lamellas
40 box
42 recess
44 rod-like element
46 wheel
48 crank handle
50 air admission hole
52 storing compartment
60 ballast element
62 loop
64 tube
66 connecting clamp

68 mounting rope

70 inlet connection piece

72 outlet connection piece

We claim:

1. An information carrier and at least one information banner received on said carrier, said carrier comprising an inflatable hollow body made of a flexible, foldable material and a blower for blowing an airflow into an inner part of said hollow body, whereby said blower is arranged in such a way that the airflow produced by said blower builds up an overpressure within said hollow body and said hollow body adopts a stationary and stable outer shape, said hollow body forming a closed, rectangular frame enclosing an open area, over which the information banner is fastened while at least partly covering the open area constituted by the frame, and said information banner is net-like and permeable to wind.

2. The information carrier according to claim 1, wherein a lip is provided on at least one side of said hollow body onto which the information banner can be secured.

3. The information carrier according to claim 2, wherein said lip is formed by an outwardly showing fold on said inflatable hollow body.

4. The information carrier according to claim 2, wherein said lip is provided with a number of eyes and hook and loop fasteners for securing the information banner onto said hollow body.

5. An information carrier and at least one information banner which is net-like and permeable to wind, said carrier comprising an inflatable hollow body made of a flexible, foldable material and a blower for blowing an airflow into an inner part of said hollow body, whereby said blower is arranged in such a way that the airflow produced by said blower builds up an overpressure within said hollow body and said hollow body adopts a stationary and stable outer shape, said hollow body forming a closed, rectangular frame enclosing an open area, over which the information banner is fastened while at least partly covering the open area constituted by the frame and an opaque structure being arranged within said closed frame and behind the information banner.

6. The information carrier according to claim 5, wherein said opaque structure comprises several, removable lamellas fastened on said hollow body.

7. The information carrier according to claim 6, wherein said lamellas are permeable to wind and are made out of a net-like material.

8. The information carrier according to claim 5, wherein a holding lip is provided on an inner side of said hollow body and said lamellas are mountable onto said lip.

9. The information carrier according to claim 1, further comprising a box having a semi-cylindrical recess for a form-fitting reception of said inflated hollow body, said box being arranged on an underside of said hollow body, and further wherein the box has a bottom whereas said recess at least nearly reaches the bottom of said box.

10. The information carrier according to claim 9, wherein rod-shaped elements are provided on an edge of said recess, said elements engaging into corresponding loops arranged on said hollow body for maintaining said hollow body on said box.

11. The information carrier according to claim 9, wherein said blower is positioned in said box.

12. The information carrier according to claim 9, further comprising wheels arranged on said box and being adjustable in height.

13. The information carrier according to claim 9, wherein said box is provided with a storing compartment for receiving a folded ballast element.

14. The information carrier according to claim 1, further comprising a ballast element which can be movably placed onto the ground, said ballast element comprising a liquid-proof, flexible and foldable material, said ballast element being mountable to an anchoring cable attached to said hollow body and being fillable with a liquid.

15. The information carrier according to claim 14, wherein said ballast element has a pyramidal shape.

16. The information carrier according to claim 14, wherein loops are provided on edges of said ballast element into which tubes or rods are engaged, whereas said tubes or rods are connected to each other on their free ends by means of connecting clamps.

17. An information carrier for receiving at least one information banner comprising:

an inflatable hollow body made of a flexible, foldable net-like fabric material and a blower for blowing an airflow into an inner part of said hollow body, whereby said blower is arranged in such a way that the airflow produced by said blower builds up an over pressure within said hollow body and said hollow body adopts a stationary and stable outer shape, said hollow body forming a closed frame enclosing an open area, over which the information banner is fastened while at least partly covering the open area constituted by the closed frame and a lip being provided on at least one side of said hollow body onto which the information banner can be secured.

18. An information carrier and at least one information banner comprising:

an inflatable hollow body made of a flexible, foldable material and a blower for blowing an airflow into an inner part of said hollow body, whereby said blower is arranged in such a way that the airflow produced by said blower builds up an overpressure within said hollow body and said hollow body adopts a stationary and stable outer shape, said hollow body forming a closed frame enclosing an open area, over which the information banner is fastened while at least partly covering the open area constituted by the frame; and a ballast element which can be movably placed onto the ground, said ballast element comprising a liquid-proof, flexible and foldable material, said ballast element being mountable to an anchoring cable attached to said hollow body and being fillable with a liquid and further wherein loops are provided on edges of said ballast element into which tubes or rods are engaged wherein said tubes or rods are connected to each other on their free ends by means of connecting clamps.

* * * * *